US009662520B2

(12) United States Patent
Sinunu

(10) Patent No.: US 9,662,520 B2
(45) **Date of Patent: *May 30, 2017**

(54) FIRE SUPPRESSION COMPOSITIONS AND METHODS OF TREATING SUBTERRANEAN FIRES

(71) Applicant: EnvironX Solutions, Inc., Colleyville, TX (US)

(72) Inventor: Stephen A. Sinunu, Colleyville, TX (US)

(73) Assignee: EnvironX Solutions, Inc., Colleyville, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/848,977

(22) Filed: Sep. 9, 2015

(65) Prior Publication Data

US 2015/0375022 A1 Dec. 31, 2015

Related U.S. Application Data

(63) Continuation of application No. 13/794,250, filed on Mar. 11, 2013, now Pat. No. 9,155,929.

(Continued)

(51) Int. Cl.

| | |
|---|---|
| ***A62C 3/00*** | (2006.01) |
| ***A62C 3/02*** | (2006.01) |
| ***A62D 1/00*** | (2006.01) |

(52) U.S. Cl.

CPC ..... *A62C 3/0292* (2013.01); *A62C 3/02* (2013.01); *A62D 1/0035* (2013.01)

(58) Field of Classification Search

CPC ..... A62C 3/02; A62C 3/0228; A62C 3/0235; A62C 3/0242; A62C 3/0292; A62D 1/0035

(Continued)

(56) References Cited

U.S. PATENT DOCUMENTS 4,606,831 A * 8/1986 Kegeler ..... A62D 1/0035 106/205.1
4,641,711 A * 2/1987 Terry ..... E21F 15/00 166/288

(Continued)

FOREIGN PATENT DOCUMENTS

WO 2013169489 A1 11/2013

OTHER PUBLICATIONS

Eve Gelastopoulus, Up in Smoke; Brush Fires Dog Bone-Dry Bay State, Aug. 2, 1997, Boston Herald.*

(Continued)

*Primary Examiner* — Arthur O Hall
*Assistant Examiner* — Juan C Barrera
(74) *Attorney, Agent, or Firm* — Conley Rose, P.C.; Rodney B. Carroll

(57) ABSTRACT

A method of suppressing, reducing and/or extinguishing a subterranean fire comprising contacting the subterranean fire with a fire-suppression composition comprising a carrier agent and a flame-retardant salt. A method of treating a peat fire comprising locating one or more hot spots associated with the peat fire, preparing an aqueous solution of a fire-suppression composition comprising guar and monoammonium phosphate, wherein a ratio of guar to monoammonium phosphate is about 30:70; and contacting the peat fire with the aqueous solution.

20 Claims, 1 Drawing Sheet

Related U.S. Application Data

(60) Provisional application No. 61/645,852, filed on May 11, 2012.

(58) Field of Classification Search
USPC ..... 169/43, 45, 46
See application file for complete search history.

(56) References Cited

U.S. PATENT DOCUMENTS

| | | | | |
|---|---|---|---|---|
| 4,725,370 | A * | 2/1988 | Greene | A62D 1/0035 169/47 |
| 5,425,886 | A | 6/1995 | Smith | |
| 7,334,644 | B1 * | 2/2008 | Ozment | A62C 2/06 169/15 |
| 9,155,929 | B2 | 10/2015 | Sinunu | |
| 2005/0011653 | A1 * | 1/2005 | Strabala | E21F 5/06 169/46 |
| 2009/0078433 | A1 * | 3/2009 | Hussey | A62C 3/00 169/47 |
| 2012/0018151 | A1 * | 1/2012 | Ide | E21B 43/166 166/251.1 |
| 2012/0255745 | A1 * | 10/2012 | Brown | E21F 5/00 169/46 |

OTHER PUBLICATIONS

Filing receipt and specification for provisional patent application entitled "Fire suppression compositions and methods of treating subterranean fires", by Stephen A. Sinunu, filed on May 11, 2012 as U.S. Appl. No. 61/645,852.

Foreign communication from a related counterpart application—International Search Report and Written Opinion, PCT/US2013/038061, Jul. 25, 2013, 13 pages.

Foreign communication from a related counterpart application—International Preliminary Report on Patentability, PCT/US2013/038061, Nov. 11, 2014, 10 pages.

Rappold, Ana G., et al., "Peat Bog Wildfire Smoke Exposure in Rural North Carolina is Associated with Cardiopulmonary Emergency Department Visits Assessed through Syndromic Surveillance," Oct. 2011, pp. 1415-1420, vol. 119, No. 10, Environmental Health Perspectives.

Wikipedia, "Peat," http://en.wikipedia.org/wiki/Peat, Feb. 27, 2014, 12 pages.

World Energy Council, "2007 Survey of Energy Resources—Executive Summary," www.worldenergy.org, 2007, pp. 1-19 plus cover sheet and three information pages.

* cited by examiner

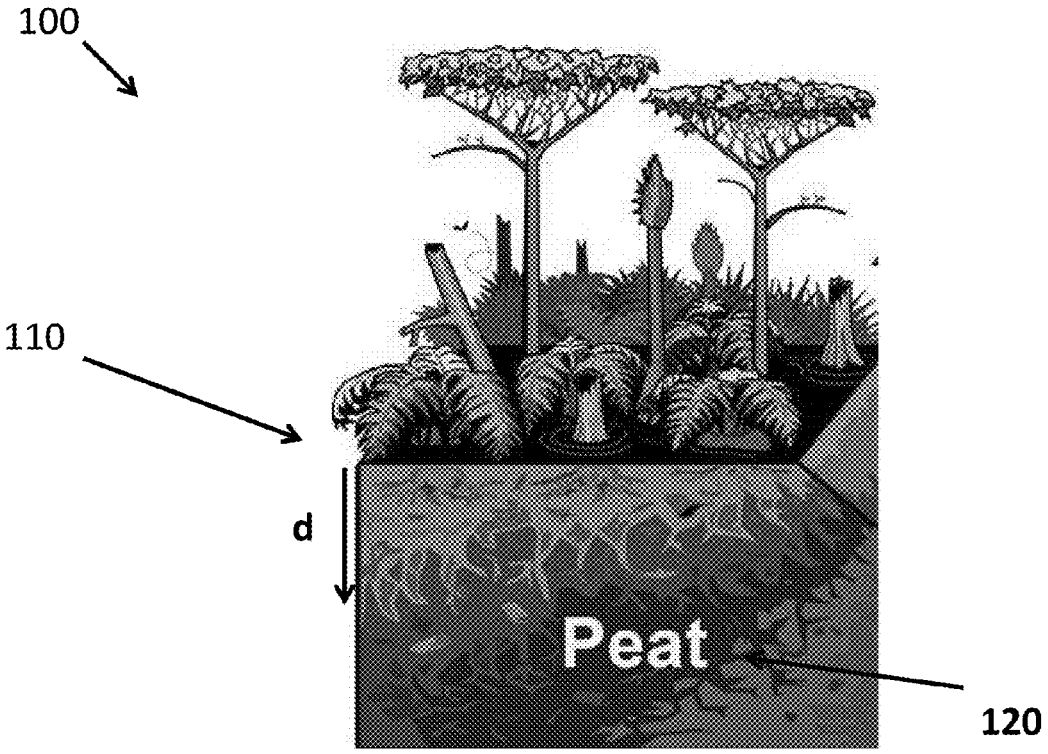
100
110
d
Peat
120

FIRE SUPPRESSION COMPOSITIONS AND METHODS OF TREATING SUBTERRANEAN FIRES

CROSS-REFERENCE TO RELATED APPLICATIONS

This application is a continuation of and claims priority to U.S. patent application Ser. No. 13/794,250 filed Mar. 11, 2013 and published as U.S. Patent Application Publication No. US 2013/0299202 A1, which is a non-provisional of and claims priority to U.S. Provisional Application No. 61/645,852, filed on May 11, 2012 and both entitled "Fire Suppression Compositions and Methods of Treating Subterranean Fires," each of which is incorporated by reference herein in its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Subterranean fires or fires fueled by sources that are located primarily below the surface of the earth (i.e., underground fires) are emerging as a global threat with significant economic, social, and ecological impacts. Conventional fire suppression methodologies used on above ground, surface fires have proven to have limited effectiveness in the case of subterranean fires. Thus, an ongoing need exists for methods and compositions to treat subterranean fires.

SUMMARY

Disclosed herein is a method of suppressing, reducing and/or extinguishing a subterranean fire comprising contacting the subterranean fire with a fire-suppression composition comprising a carrier agent and a flame-retardant salt.

Further disclosed herein is a method of treating a peat fire comprising locating one or more hot spots associated with the peat fire, preparing an aqueous solution of a fire-suppression composition comprising guar and monoammonium phosphate, wherein a ratio of guar to monoammonium phosphate is about 30:70, and contacting the peat fire with the aqueous solution.

Also disclosed herein is a method comprising contacting a subterranean fire with a fire-suppression composition to form a suppressed subterranean fire wherein the fire is located at a depth ranging from about 1 foot to about 15 feet below a surface of the earth, wherein the fire-suppression composition comprises an aqueous solution of guar and monoammonium phosphate at a ratio of guar to monoammonium phosphate of about 30:70 and wherein contacting is effected through application of the fire-suppressing composition to the earth's surface.

BRIEF DESCRIPTION OF THE DRAWINGS

For a more complete understanding of the present disclosure and the advantages thereof, reference is now made to the following brief description, taken in connection with the accompanying drawings and detailed description, wherein like reference numerals represent like parts.

FIG. 1 is a depiction of a system having a subterranean fuel source.

DETAILED DESCRIPTION

It should be understood at the outset that although an illustrative implementation of one or more embodiments are provided below, the disclosed systems and/or methods may be implemented using any number of techniques, whether currently known or in existence. The disclosure should in no way be limited to the illustrative implementations, drawings, and techniques illustrated below, including the exemplary designs and implementations illustrated and described herein, but may be modified within the scope of the appended claims along with their full scope of equivalents.

Disclosed herein are compositions and methods for treating a fire where the fuel source and related combustion/oxidation thereof is at least partially disposed below the earth's surface. Such fires are collectively termed subterranean fires or subsurface fires. Often, smoke and soot from such fires are visible above ground while other visible indication of the fire (e.g., flames, embers, coals, glowing/oxidizing material, etc.) are not visible on the earth's surface. Such fires may be characterized as smoldering fires that may continue for extended periods such as weeks, months, or even years. Such fires may further be characterized as continuing to burn (e.g., smolder and produce large quantities of smoke) when related or nearby surface fires have been extinguished. In some embodiments, a subterranean fire may be characterized by an underground combustion/oxidation that may go undetected until a sinkhole or smoke appears. In an embodiment, a subterranean fire of the type disclosed herein may not exhibit a flame unless the fire is excavated and exposed to the atmosphere.

In an embodiment, the subterranean fire is a peat fire. Peat, also termed turf, refers to an accumulation of decayed vegetation matter or histosol that can range in depth up to about 15 feet. Peat forms in wetland bogs, moors, muskegs, pocosins, mires, and peat swamp forests. Peat material may be classified as fibric, hemic, or sporic. Peat is characterized by a high carbon content with the ability to combust under low moisture conditions.

In an embodiment, the subterranean fire is a muck fire. Muck refers to a soil composed of nearly or completely decomposed vegetation.

In an embodiment, the subterranean fire is a coal seam fire. A coal seam fire or mine fire refers to the underground combustion and/or smouldering of a coal deposit, often in a coal mine.

In an embodiment, the subterranean fire is a landfill fire. Landfills, also referred to as dumps, are specialized facilities for the management of waste that typically contain excavated areas of land or depressions that serve as areas for the deposition of waste. In a landfill, waste is disposed of via burial, for example in successive layers that may result in the formation of mounds or heaped piles of waste covered by soil. Landfills have a variety of unique characteristics, which are primarily determined by the type of waste they are designed to accept. In an embodiment, the landfill is a sanitary landfill, a municipal solid waste landfill, a construction and demolition waste landfill, a hazardous waste landfill, an industrial landfill or combinations thereof. It is to be understood that in some embodiments, the landfill fire may have a fuel source that is not exposed to the earth's surface and/or is disposed beneath some amount of waste material.

In such embodiments, the fuel source may be located at or near the earth's surface but is obscured from exposure to the environment of the earth's surface by waste.

In an embodiment, the subterranean fire is a smoldering fire. In another embodiment, the subterranean fire is a propagating fire.

In an embodiment, a method of treating a subterranean fire comprises contacting the subterranean fire with a fire-suppressing composition (FSC) comprising a carrier agent and a salt-based flame retardant. The carrier agent may be any material compatible with the other components of the FSC and able to facilitate the transport of the salt-based flame retardant to the fuel source of the fire. The salt-based flame retardant may, when contacted with a subterranean fire, serve to reduce and/or eliminate the combustion of the fuel and thereby reduce and/or eliminate the products of combustion such as heat and/or smoke.

In an embodiment, the carrier agent comprises a polysaccharide, alternatively a galactomannan. In an embodiment, the carrier agent comprises guar, guar gum, guar protein, and/or a derivative of guar (collectively termed guar). In an embodiment, the carrier agent consists essentially of or is guar, guar gum, guar protein, and/or a derivative of guar (collectively termed guar). In an embodiment, the carrier agent consists essentially of or is guar. Guar may be derived from the *Cyamopsis tetragonoloba* bean, commonly referred to as gavar, guar, guwar, or guvar beans. In an embodiment, the guar is Texas guar, for example grown from seeds known as Kinman, Esser, Lewis, or Santa Cruz. Guar suitable for use in this disclosure may be characterized as a granular material having a particle size distribution that is greater than about 200 mesh, alternatively greater than about 300 mesh, or alternatively greater than about 400 mesh.

In an embodiment, the salt-based flame retardant may function to coat the fuel source and deprive the fire of a necessary reactant, oxygen. In an embodiment, the salt-based flame retardant comprises monoammonium phosphate ($NH_4H_2PO_4$). In an embodiment, the salt-based flame retardant consists essentially of or is monoammonium phosphate ($NH_4H_2PO_4$).

In an embodiment, the FSC is formed by contacting the carrier agent (e.g., guar) and the salt-based flame retardant (e.g., $NH_4H_2PO_4$). Both the carrier agent and salt-based flame retardant may be solids (e.g., powders) and thus formation of the FSC may involve dry blending of the carrier agent (e.g., guar) and the salt-based flame retardant (e.g., $NH_4H_2PO_4$). The carrier agent (e.g., guar) and the salt-based flame retardant (e.g., $NH_4H_2PO_4$) may be dry blended using any suitable device capable of providing an intimate mixture of the carrier agent (e.g., guar) and the salt-based flame retardant (e.g., $NH_4H_2PO_4$). In such embodiments, the carrier agent and salt-based flame retardant are blended in a carrier agent:salt-based flame retardant ratio effective to break surface tension and thereby readily penetrate from the surface (e.g., via surface application) into the earth to reach a subterranean fire. In such embodiments, the carrier agent and salt-based flame retardant are blended in amounts that provide a carrier agent:salt-based flame retardant ratio ranging from about 20:80 to about 40:60, alternatively, from about 25:75 to about 35:65, alternatively from about 27:73 to about 33:67, or alternatively about 30:70. In an embodiment, the FSC is a material known as Peat FireX commercially available from EnvironX Solutions Inc. of Colleyville, Tex.

In an embodiment, the FSC further comprises one or more additives to aid in the storage and/or shipment of same, for example an additive to extend shelf life such as sodium benzoate. In an embodiment, an additive to extend the shelf life (e.g., sodium benzoate) is present in the FSC in an amount of from about 2.5% to about 5.0%.

In an embodiment, a method of treating a subterranean fire (e.g., peat fire) comprises identifying one or more subterranean "hot spots" in the fire. Herein "hot spots" refer to areas where active combustion of the subterranean fuel source is occurring and/or the areas that could potentially ignite the fuel source. Identification of the hot spots may be carried out using any suitable methodology such as thermal imagery through infrared scanning (infrared thermography, IRT), visual observation (e.g., areas with smoke rising from the ground), and the like. In an embodiment, thermal imaging includes overhead imaging such as provided via a thermal imaging camera carried by an aerial platform (e.g., helicopter, airplane, balloon, drone, etc.), satellite, etc. In an embodiment, the thermal imaging is provided to one or more firefighters coordinating application of the FSC, for example via a real time computerized application and associated map (e.g., GPS enabled topographical map). In an embodiment, real time thermal imaging data is provided via a remote controlled aerial platform such as an unmanned helicopter or aircraft drone that may circle overhead for an extended period of time.

In an embodiment, a method of treating a subterranean fire further comprises preparing a solution of the FSC. The FSC solution may be prepared by contacting the FSC with a suitable aqueous liquid (e.g., water) in an amount sufficient to provide a solution concentration of the FSC ranging from about 5% w/w to about 50% w/w, alternatively from about 10% w/w to about 50% w/w, or alternatively from about 10% w/w to about 25% w/w. In an embodiment, the water may be fresh water, brackish water, or a partial or completely saturated salt solution.

The method may further comprise contacting the subterranean fire with the FSC solution. Any suitable method for contacting the FSC solution with the subterranean fire may be employed. In an embodiment, one or more access sites to the subterranean fire are created (e.g., by excavating or digging holes to the fuel source) and the FSC solution is contacted with the subterranean fire by being placed into the access site. Additionally or alternatively, the FSC solution is injected into the ground above the subterranean fire. Such injections may be designed to introduce the FSC solution into the fuel source, or may provide the FSC solution in proximity of the fuel source. Additionally or alternatively, the FSC solution is sprayed directly upon the earth's surface proximate the hot spot or area of subterranean combustion, as described herein.

In some embodiments, a method of treating a subterranean formation excludes the formation of one or more access sites having fluid connectivity with both the surface of the earth and the fuel source. In other words, in some embodiments, the FSC solution is applied without the need for excavating, drilling, digging, etc., and the associated heavy equipment, surface destruction, expense, etc. associated with same. For example, conventional methods of utilizing fire-suppressing compositions may involve the creation of one or more access sites (e.g., holes or conduits) leading from the surface of the earth to the fuel source of the subterranean fire or to an area proximate to the fuel source. In such conventional methods the access sites may be used to transport materials (e.g., water) to the fuel source. In an embodiment, FSCs of the type disclosed herein may suppress subterranean fires without the need to create access sites from the surface of the earth to the subterranean fire.

In another embodiment, the FSC solution is applied topically to the surface area above the subterranean fire. In such embodiments, the FSC solution penetrates a distance down through earth material to reach the combusting fuel and suppress and/or extinguish same. Application of the FSC solution may be carried out using any suitable methodology and/or equipment. In an embodiment, the FSC solution application is ground-based and may utilize techniques such as hose spraying of the solution via a vehicle mounted spraying device (e.g., ATV mounted sprayers, truck-bed mounted sprayers, trailer mounted sprayers, tractor mounted sprayers, etc.). Additionally or alternatively the FSC solution application is aerial and may employ aerial firefighting methodologies such as airtankers, spray planes, waterbombers, or helicopters. In an embodiment, the FSC solution application is aerial and employs a helicopter equipped with a Bambi bucket and a solution storage container. In such embodiments, the FSC solution may be transferred from the solution storage container to the bucket which then deposits the transferred FSC solution onto an area above or in proximity to a subterranean fire. In such embodiments, the FSC solution may be applied in quantities of from about 100 gallons to about 250 gallons at a time.

The FSC solution once applied may penetrate the earth to the depth necessary to contact and suppress, reduce and/or extinguish the subterranean fire. For example, and with reference to FIG. 1, a system 100 may be identified which has fuel/combustible material 120 (e.g., peat) located at some depth, d, below the surface of the earth 110. In an embodiment d is from about 1 foot to about 15 feet, alternatively d is from about 2 feet to about to about 15 feet, alternatively d is from about 5 feet to about 15 feet. In an embodiment, an FSC of the type disclosed herein is applied to the surface 110 and penetrates to a depth d to contact the combustible material and suppress the fire.

Subterranean fires may further be characterized by a propensity to reignite following an initial determination that the fire has been suppressed. The initial determination that the fire has been suppressed may be made by one or more individuals involved in the fire suppression efforts (e.g., firefighters) and characterized by the cessation of fire suppression efforts. Subterranean fires treated with FSCs of the type disclosed herein may display a reduced tendency to reignite following the initial determination that the fire has been suppressed. For example the tendency of subterranean fires treated with FSCs of the type disclosed herein to reignite may be decreased by about 50%, 75%, or 100% when compared to subterranean fires not treated with FSCs of the type disclosed herein. Herein the propensity of a subterranean fire to reignite after being suppressed is termed the reignition index (RI) and ranges from 1 to 100 where the greater the value of RI, the more likely the subterranean fire is to reignite after initial suppression. In an embodiment, a subterranean fire (e.g., peat) initially suppressed with water may have a RI of about 100 while a subterranean fire initially suppressed with an FSC of the type disclosed herein may have an RI of about 1. In an embodiment, a subterranean fire treated with an FSC of the type disclosed herein has an RI of less than about 10, alternatively less than about 5, or alternatively about 1.

The following enumerated embodiments are provided as non-limiting examples.

A first embodiment which is a method of suppressing, reducing and/or extinguishing a subterranean fire comprising contacting the subterranean fire with a fire-suppression composition comprising a carrier agent and a flame-retardant salt.

A second embodiment which is the method of the first embodiment wherein the fire-suppression composition is an aqueous solution comprising the carrier agent and the flame-retardant salt.

A third embodiment which is the method of any one of the first through second embodiments wherein the subterranean fire comprises a peat fire, a muck fire, a coal seam fire, or a landfill fire.

A fourth embodiment which is the method of any one of the first through third embodiments wherein the fire is smoldering.

A fifth embodiment which is the method of any one of the first through fourth embodiments wherein the fire is propagating.

A sixth embodiment which is the method of any one of the first through fifth embodiments wherein the carrier agent comprises a polysaccharide.

A seventh embodiment which is the method of the sixth embodiment wherein the polysaccharide comprises a galactomannan.

An eighth embodiment which is the method of the seventh embodiment wherein the galactomannan comprises guar.

A ninth embodiment which is the method of the eighth embodiment wherein the guar has a mesh size of greater than about 200.

A tenth embodiment which is the method of any one of the first through ninth embodiments wherein the flame-retardant salt comprises monoammonium phosphate.

An eleventh embodiment which is the method of any one of the first through tenth embodiments wherein the carrier agent and flame-retardant salt are solid.

A twelfth embodiment which is the method of any one of the first through eleventh embodiments wherein a ratio of carrier agent:flame-retardant salt is about 30:70.

A thirteenth embodiment which is the method of any one of the first through twelfth embodiments wherein contacting comprises topical application of the fire-suppression composition onto an area of the earth's surface above the subterranean fire.

A fourteenth embodiment which is the method of the thirteenth embodiment wherein topical application comprises ground-based application of the fire-suppression composition onto an area of the earth's surface above the subterranean fire.

A fifteenth embodiment which is the method of any one of the thirteenth through fourteenth embodiments wherein topical application comprises aerial-based application of the fire-suppression composition onto an area of the earth's surface above the subterranean fire.

A sixteenth embodiment which is the method of any one of the first through fifteenth embodiments further comprising preparing the aqueous solution of the fire-suppression composition by dissolving a blended mixture of solid carrier agent and solid flame-retardant salt in water.

A seventeenth embodiment which is the method of the sixteenth embodiment wherein the aqueous solution is prepared on location near the subterranean fire.

An eighteenth embodiment which is the method of any one of the sixteenth through seventeenth embodiments wherein the blended mixture is added to a reservoir associated with a vehicular mounted spraying device.

A nineteenth embodiment which is the method of any one of the second through eighteenth embodiments wherein the aqueous solution has concentration of from about 5% w/w to about 50% w/w.

A twentieth embodiment which is a method of treating a peat fire comprising locating one or more hot spots associated with the peat fire; preparing an aqueous solution of a fire-suppression composition comprising guar and monoammonium phosphate, wherein a ratio of guar to monoammonium phosphate is about 30:70; and contacting the peat fire with the aqueous solution.

A twenty-first embodiment which is the method of the twentieth embodiment wherein the guar has a mesh size of greater than about 300.

A twenty-second embodiment which is the method of any one of the twentieth through twenty-first embodiments wherein the aqueous solution has concentration of from about 5% w/w to about 50% w/w.

A twenty-third embodiment which is the method of the twenty-second embodiment wherein the aqueous solution is applied to a surface area located above the peat fire, and the aqueous solution penetrates through the earth a distance to reduce, suppress, or extinguish the peat fire.

A twenty-fourth embodiment which is the method of the twenty-third embodiment wherein placement of the solution is aided with thermal imaging data.

A twenty-fifth embodiment which is a method comprising contacting a subterranean fire with a fire-suppression composition to form a suppressed subterranean fire wherein the fire is located at a depth ranging from about 1 foot to about 15 feet below a surface of the earth, wherein the fire-suppression composition comprises an aqueous solution of guar and monoammonium phosphate at a ratio of guar to monoammonium phosphate of about 30:70 and wherein contacting is effected through application of the fire-suppressing composition to the earth's surface.

A twenty-sixth embodiment which is a method of the twenty-fifth embodiment wherein the method excludes formation of one or more access sites from the earth's surface to the subterranean fire.

A twenty-seventh embodiment which is the method of any one of the twenty-fifth through twenty sixth embodiments wherein the subterranean formation comprises a peat fire, a muck fire, a coal seam fire, a smoldering fire, a landfill fire, or combinations thereof.

A twenty-eighth embodiment which is the method of the twenty-seventh embodiment wherein the subterranean fire occurs at a municipal solid waste landfill.

A twenty-ninth embodiment which is the method of any one of the twenty-fifth through twenty-eighth embodiments wherein the suppressed subterranean fire has a reignition index of less than about 10.

A thirtieth embodiment which is the method of any one of the twenty-fifth through twenty-ninth embodiments wherein the suppressed fire has a tendency to reignite that is reduced by greater than about 50% when compared to subterranean fire that is not contacted with the fire-suppression composition.

A thirty-first embodiment which is the method of any one of the twenty-fifth through twenty-ninth embodiments wherein the aqueous solution has concentration of from about 5% w/w to about 50% w/w.

A thirty-second embodiment which is a method comprising identifying one or more sites of fuel combustion wherein the site is located at a depth of from about 1 foot to about 15 feet below the earth' surface; creating one or more conduits from the earth's surface to one or more sites proximate to the site of fuel combustion; and introducing to the conduit a fuel-suppression composition comprising an aqueous solution of guar and monoammonium phosphate, wherein a ratio of guar to monoammonium phosphate is about 30:70.

A thirty-third embodiment which is the method of the thirty-second embodiment wherein the aqueous solution has a concentration of from about 5% w/w to about 50% w/w.

While embodiments of the disclosure have been shown and described, modifications thereof can be made by one skilled in the art without departing from the spirit and teachings of the disclosure. The embodiments described herein are exemplary only, and are not intended to be limiting. Many variations and modifications of the disclosure disclosed herein are possible and are within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_L$, and an upper limit, $R_U$, is disclosed, any number falling within the range is specifically disclosed. In particular, the following numbers within the range are specifically disclosed: $R=R_L+k*(R_U-R_L)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the embodiments of the present disclosure. The discussion of a reference herein is not an admission that it is prior art to the present disclosure, especially any reference that may have a publication date after the priority date of this application. The disclosures of all patents, patent applications, and publications cited herein are hereby incorporated by reference, to the extent that they provide exemplary, procedural, or other details supplementary to those set forth herein.

What is claimed is:

1. A method of suppressing, reducing and/or extinguishing a subterranean fire comprising applying an aqueous solution of guar and monoammonium phosphate at a ratio of guar to monoammonium phosphate of about 30:70 to an area of the earth's surface above the subterranean fire and allowing the aqueous solution to penetrate through soil to contact the subterranean fire and suppress, reduce, and/or extinguish the subterranean fire.

2. The method of claim 1 wherein the aqueous solution penetrates from about 1 foot to about 15 feet of soil to contact the subterranean fire.

3. The method of claim 1 wherein the subterranean fire comprises a peat fire, a muck fire, a coal seam fire, or a landfill fire.

4. The method of claim 2 wherein the subterranean fire comprises a peat fire, a muck fire, a coal seam fire, or a landfill fire.

5. The method of claim 1 wherein the suppressed, reduced and/or extinguished subterranean fire has a reignition index of less than about 10.

6. The method of claim 4 wherein the suppressed, reduced and/or extinguished subterranean fire has a reignition index of less than about 10.

7. The method of claim 1 wherein the aqueous solution is applied via an aerial-based application.

8. The method of claim 6 wherein the aqueous solution is applied via an aerial-based application.

9. The method of claim 1 wherein the aqueous solution has concentration of from about 5% w/w to about 50% w/w.

10. The method of claim 6 wherein the aqueous solution has concentration of from about 5% w/w to about 50% w/w.

11. The method of claim 1 wherein the guar has a mesh size of greater than about 200.

12. The method of claim 10 wherein the guar has a mesh size of greater than about 200.

13. A method of treating a subterranean peat fire comprising:

preparing an aqueous solution of guar and monoammonium phosphate at a ratio of about 30:70;

locating one or more hot spots associated with the subterranean peat fire;

applying the aqueous solution to an area of the earth's surface above the hot spot; and allowing the aqueous solution to penetrate through soil to contact the hot spot and suppress, reduce, and/or extinguish the subterranean peat fire.

14. The method of claim 13 wherein the aqueous solution penetrates from about 1 foot to about 15 feet of soil to contact the hot spot.

15. The method of claim 14 wherein the suppressed, reduced and/or extinguished subterranean peat fire has a reignition index of less than about 10.

16. The method of claim 15 wherein the aqueous solution has concentration of from about 5% w/w to about 50% w/w.

17. A method of treating a subterranean fire comprising:

preparing an aqueous solution of guar and monoammonium phosphate at a ratio of about 30:70;

locating one or more hot spots associated with the subterranean fire;

applying the aqueous solution to an area of the earth's surface above the hot spot; and allowing the aqueous solution to penetrate through soil to contact the hot spot and suppress, reduce, and/or extinguish the subterranean fire, wherein the suppressed, reduced, and/or extinguished subterranean fire has a tendency to reignite that is reduced by greater than about 50% when compared to an otherwise similar subterranean fire that is suppressed, reduced, and/or extinguished by contact with a fire-suppression composition that does not comprise an aqueous solution of guar and monoammonium phosphate at a ratio of about 30:70.

18. The method of claim 17 wherein the subterranean fire comprises a peat fire, a muck fire, a coal seam fire, or a landfill fire.

19. The method of claim 18 wherein the aqueous solution penetrates from about 1 foot to about 15 feet of soil to contact the hot spot.

20. The method of claim 19 wherein the aqueous solution has concentration of from about 5% w/w to about 50% w/w.

* * * * *